US008578922B1

(12) United States Patent
Granger

(10) Patent No.: US 8,578,922 B1
(45) Date of Patent: Nov. 12, 2013

(54) AUTOMATIC AIRGUN METHOD AND APPARATUS

(76) Inventor: Christopher George Granger, Kennesaw, GA (US)

( * ) Notice: Subject to any disclaimer, the term of this patent is extended or adjusted under 35 U.S.C. 154(b) by 501 days.

(21) Appl. No.: 12/505,452

(22) Filed: Jul. 17, 2009

Related U.S. Application Data

(60) Provisional application No. 61/081,665, filed on Jul. 17, 2008.

(51) Int. Cl.
*F41B 11/00* (2013.01)

(52) U.S. Cl.
USPC ..... 124/74; 124/71; 124/73

(58) Field of Classification Search
USPC ..... 124/56–77
See application file for complete search history.

(56) References Cited

U.S. PATENT DOCUMENTS

| | | | | |
|---|---|---|---|---|
| 2,568,432 | A * | 9/1951 | Cook | 124/65 |
| 2,834,332 | A * | 5/1958 | Guthrie | 124/65 |
| 4,148,245 | A * | 4/1979 | Steffanus et al. | 89/7 |
| 5,494,024 | A * | 2/1996 | Scott | 124/73 |
| 5,497,758 | A * | 3/1996 | Dobbins et al. | 124/73 |
| 5,727,538 | A * | 3/1998 | Ellis | 124/77 |
| 5,769,066 | A * | 6/1998 | Schneider | 124/75 |
| 6,138,656 | A * | 10/2000 | Rice et al. | 124/73 |
| 6,142,137 | A * | 11/2000 | MacLaughlin | 124/72 |
| 6,520,171 | B2 * | 2/2003 | Reible | 124/73 |
| 6,694,963 | B1 * | 2/2004 | Taylor | 124/32 |
| 6,802,306 | B1 * | 10/2004 | Rice | 124/74 |
| 6,857,422 | B2 * | 2/2005 | Pedicini et al. | 124/63 |
| 7,150,276 | B1 * | 12/2006 | Rice | 124/73 |
| 7,699,047 | B2 * | 4/2010 | Tippman et al. | 124/73 |
| 7,712,462 | B2 * | 5/2010 | Pedicini et al. | 124/65 |
| 7,735,479 | B1 * | 6/2010 | Quinn et al. | 124/73 |
| 7,866,309 | B2 * | 1/2011 | Juan | 124/73 |
| 7,913,679 | B2 * | 3/2011 | Quinn et al. | 124/77 |
| 2002/0096164 | A1 * | 7/2002 | Perrone | 124/77 |
| 2002/0170552 | A1 * | 11/2002 | Gardner, Jr. | 124/56 |
| 2004/0065310 | A1 * | 4/2004 | Masse | 124/75 |
| 2005/0188974 | A1 * | 9/2005 | Pedicini et al. | 124/65 |
| 2005/0235975 | A1 * | 10/2005 | Pedicini et al. | 124/67 |
| 2006/0005823 | A1 * | 1/2006 | Quinn et al. | 124/73 |
| 2006/0107939 | A1 * | 5/2006 | Dobbins | 124/73 |
| 2006/0207587 | A1 * | 9/2006 | Jones et al. | 124/74 |
| 2007/0017497 | A1 * | 1/2007 | Masse | 124/73 |
| 2007/0068502 | A1 * | 3/2007 | Jones et al. | 124/77 |
| 2007/0186916 | A1 * | 8/2007 | Jones | 124/74 |
| 2007/0215135 | A1 * | 9/2007 | Campo | 124/77 |
| 2008/0011284 | A1 * | 1/2008 | Styles et al. | 124/77 |
| 2008/0173291 | A1 * | 7/2008 | Halmone | 124/77 |
| 2009/0025701 | A1 * | 1/2009 | Douglas et al. | 124/77 |
| 2009/0056693 | A1 * | 3/2009 | Pedicini et al. | 124/73 |
| 2009/0101129 | A1 * | 4/2009 | Wood et al. | 124/77 |
| 2009/0114202 | A1 * | 5/2009 | Dobbins | 124/76 |
| 2009/0199830 | A1 * | 8/2009 | Skilling | 124/3 |
| 2009/0199833 | A1 * | 8/2009 | Li | 124/77 |
| 2009/0308371 | A1 * | 12/2009 | Lian | 124/77 |
| 2010/0012109 | A1 * | 1/2010 | Lai | 124/77 |
| 2010/0154767 | A1 * | 6/2010 | Masse | 124/77 |
| 2010/0307472 | A1 * | 12/2010 | Witzigreuter | 124/69 |

* cited by examiner

*Primary Examiner* — Michael David

(57) ABSTRACT

Example embodiments of an automatic airgun method and apparatus which enable automatic and/or semi-automatic projectile propulsion. Embodiments may be implemented with selective-fire, variable rate-of-fire, and/or variable velocity projectiles. Embodiments may employ any suitable propellant that can achieve or be caused to achieve a fluid state above ambient pressure. Some variations and alternatives are described.

32 Claims, 4 Drawing Sheets

AUTOMATIC AIRGUN METHOD AND APPARATUS

CROSS REFERENCE TO RELATED APPLICATIONS

This application claims the benefit of provisional application for patent Ser. No. 61/081,665, filed 2008 Jul. 17 by the present inventor.

FEDERALLY SPONSORED RESEARCH

Not Applicable

SEQUENCE LISTING OR PROGRAM

Not Applicable

BACKGROUND

1. Field of Invention

This invention relates to airgun methods and apparatuses, the type of which are used for projectile propulsion, and specifically to those airguns having means to launch successive projectiles without reloading and/or re-cocking the device, principally via a single continuous trigger activation (fully-automatic) and repetitive trigger activation per projectile launch (semi-automatic).

The ability of both semi and fully-automatic modes in the same device is commonly known as "selective-fire," which is a term most commonly used for firearms but is sometimes applied to other projectile propulsion devices (such as airguns), and is used herein for that purpose.

The term "airgun" is commonly used (and is used herein) to describe all projectile launching devices using any fluid and/or any variety or combination(s) of fluids for propellant (such as nitrogen, helium, CO2, etc.) and is not exclusive to devices powered specifically by "air;" it represents a convenient and popular term used to classify all such fluid powered devices.

The term "BB" is commonly used (and is generally used herein unless otherwise specified) to describe metallic round shot of various calibers, unless such is otherwise specified as plastic or another material (this is a more general definition than the formal term "BB" which can more specifically indicate approximately 0.177 caliber round shot). The term "pellet" is commonly used (and is generally used herein unless otherwise specified) to describe any other type of shot, as for instance cylindrical and/or "bullet shaped" steel, lead, plastic, and/or any other type of shot.

2. Prior Art

Projectile propulsion methods using fluid propellants either pre-stored or otherwise initiated to become above-ambient pressure (such as air, nitrogen, helium, CO2, refrigerant vapors, steam, flash/catalyst heated fluids, compression heating, and so forth) have a long history. In general, these use a predetermined means to direct an above ambient pressure propellant into a breech in order to propel a projectile placed into the breech through a barrel, thereby causing it to travel at a some velocity. All such devices (including the present invention described herein) are now referred to and classified as "traditional airguns."

The foundational physical principles of airguns may be similar across devices, but the methods of their implementation and application can vary significantly. Airgun methods which launch projectiles successively via cycling the action automatically when given a single continuous trigger activation (fully-automatic operation) are rare in the prior art when compared to single-shot and/or semi-automatic units, and selective-fire versions (those having both semi and fully-automatic modes) are even more rare. Moreover, all known automatic airgun methods suffer from significant drawbacks.

Due to inefficiencies and complexities of all-mechanical propellant-driven automatic airguns, improved methods were developed which incorporated electrical means for controlling the propellant flow within such devices; examples begin circa 1937 with the MacGlashan BB Gun, and continue through today, yielding two popular classes of such electro-mechanical automatic airgun methods—motorized spring-air automatic airguns and "pre-charged" automatic airguns using electro-mechanical actuators (the latter being similar to the MacGlashan BB Gun).

Motorized Spring-Air Automatic Airguns

Motorized spring-air guns use an electric motor driven spring-piston type system to rapidly compress and thus heat air which generates the necessary above ambient pressure propellant. Current devices utilizing such methods are complex, inefficient, and relatively heavy. They require motors, pistons, gears, and sliding seals involving precision machining of mechanical components which wear and are difficult to manufacture; they generate their muzzle energy from a conversion of electrical-to-mechanical energy, the power sources of which typically have relatively low power density (usually common batteries).

Although I have developed several improvements within this class that show promise for achieving higher power and better efficiencies, when using the known techniques and existing common power sources, resulting devices are generally confined to the relatively low-power domain, and remain more complex, difficult to manufacture, and more expensive than other possible implementations—namely pre-charged systems.

Pre-Charged Automatic Airguns Using Electro-Mechanical Actuators

Pre-charged automatic airguns using electro-mechanical actuators (such as solenoids) use such electro-mechanical actuators to control a valve system which subsequently controls the flow of propellant for creating the projectile motive force; the system is controlled electronically to allow repeat cycling of the action. The numerous and particular arrangements, types, combinations and improvements of valve means, actuator means, and control means (with examples starting from circa 1937 with the MacGlashan BB Gun) are what separates these methods in the prior art.

Common Modern Valve Classes for Electro-Mechanical Automatic Airguns

In electro-mechanical automatic airguns today, there are two major valve-type subclasses: poppet-valves and spool-valves (both commonly encountered in paintball gun applications). However, all prior art automatic airgun methods using these valving types (and all other valving types) have major shortcomings and drawbacks.

In the case of poppet-valve electro-mechanical automatic airguns, a hammer, which is either driven mechanically and/or activated electrically, or directly driven by an electro-mechanical actuator (typically a solenoid) or otherwise driven via an arrangement of other electro-mechanically actuated valves and/or connected to a fluid-driven ram, is used to strike open a poppet valve to allow flow of propellant for providing motive force. This system has several drawbacks. First, it generally requires (at minimum) a sliding seal and/or elastomer valve seal for the poppet-valve control pin (and/or actuator ram) and an impact surface for the hammer, adding critical manufacturing and wear points. Next, the poppet valve response is a function of the impact force, mechanical return spring force, frictional forces, and propellant reservoir pressure—thus, precise control can become relatively difficult in the basic implementations and additional mechanisms are often required to insure shot consistency; this can become more pronounced with high firing rates. In existing embodiments, such poppet valve methods as used on automatic airguns require higher operating pressures (and are more noisy) than compared to other methods; they can additionally exhibit high vibration depending on the implementation.

In the case of spool-valve electro-mechanical automatic airguns, a tubular sliding valve (the spool-valve) is controlled by an electrical actuator (typically a solenoid), and/or a complex arrangement of electro-mechanically and/or fluid actuated valves, to route the propellant via a relatively intricate series of porting and/or venting through the valve (and often associated sub-reservoirs) with the valve also typically acting as a bolt (to control the loading of projectiles) and serving as a valve outlet port. Spool-valve designs generally require multiple sealing surfaces, intricate sliding seals, precision porting, and the resulting increased cost and complexity in manufacturing; they tend to be less reliable, more complex, less efficient, higher maintenance, and subject to faster wear then their poppet-valve counterparts. All currently known designs using spool-valve/bolt loaded projectiles require further throw than typical with a solenoid and thus must control the bolt's movement via fluid porting, thus creating significant complexity. But, such spool-valves also typically provide less vibration, quieter operation, and allow significantly lower operating pressure requirements than poppet-valves.

General Background on Pre-Charged Electro-Mechanical Automatic Airgun Methods

Electro-mechanical techniques (and electric valve actuation) have a long history in a variety of airgun applications. As such, there are several related electro-mechanical automatic airgun methods known in the art, but all have significant drawbacks and shortcomings.

The earliest of these is the MacGlashan BB Gun circa 1937 which utilized an electro-mechanical plus pneumatic piston arrangement and solenoid actuator to route propellant to the breech; it is in many ways similar in operation to the aforementioned spool-valve systems with a somewhat different valve arrangement and generally more complex mechanical operation. This airgun used an involved arrangement of levers, pistons, ports, sliding seals, position sensors and feed systems to realize the method; it was very intricate, generally inelegant, and did not have any provisions for selective-fire.

U.S. Pat. No. 3,695,246 (1971) describes a relatively complex automatic "pellet" gun (but apparently functional only with round shot BBs or paintballs) which also uses electro-mechanically operated valves for propellant channeling. The control system is largely inelegant and comprises components using complex electro-mechanical arrangements. The automatic cycling method and feed system is significantly more complex than in other methods; it necessitates optoelectronic sensing, alternating drive current, and precision machining. The device is full of linkages, chains, clutches, and other mechanisms and does not lend itself to portability or selective-fire operation.

U.S. Pat. No. 5,727,538 (1996) also describes an automatic airgun using electronic valve actuation, and is similar to the MacGlashan design in this regard and several other respects. For instance, both devices incorporate mechanical position sensing in reciprocating components which couple to the firing cycle. Further, U.S. Pat. No. 5,727,538 not only relies on the requirement of a reciprocating bolt for its automatic operational method, but also that the bolt must have a "through aperture to allow passage of compressed gas" for operation. This requirement limits the effective valve orifice size, increases propellant flow losses, and increases dead-space; the patent also notes the requirement of electronic detection of both the bolt and projectile positions, adding additional complexity to the device (and thus coupling the mechanical action to the firing sequence).

A selective-fire, burst-mode electro-mechanical automatic BB gun made by Baikal called the "Drozd" uses an electrically powered solenoid-driven hammer-based poppet valve—and, it possesses several of the corresponding limitations as noted earlier (including sliding seals and impact surfaces). It employs part of the valve as a projectile feeder pin (similar in this regard to U.S. Pat. No. 5,727,538) and inverts the poppet; this serves to help the projectile feed mechanism but creates a flow restriction which reduces the effective valve orifice size and can lower performance. Further, the valve activation and dwell times are coupled and generally controlled by the hammer impact and the mechanical response time of the valve return spring and internal pressure, resulting in a relatively limited adjustment range without resorting to mechanical means or more complex control circuitry. Moreover, there is no straightforward provision or alternative mode for preventing propellant from entering the projectile magazine given its method.

The above generally represent the simplest and most comprehensive examples of methods for electro-mechanical automatic airguns found in the prior art—and clearly, none are very simple. It has so far proved impossible (since at least circa 1937 and until this present invention) for anyone to create an electro-mechanical automatic airgun less complex than those described, let alone one which addresses the typical shortcomings and drawbacks inherent to each method.

In addition to their respective shortcomings, drawbacks, and complexities, none of the known prior art methods incorporate all the elements and advantages of pre-charged fluids, non-impact valve actuation, unobstructed breech porting, and valve control means with selective-fire operation—even irrespective of their typically high complexities. All examples of prior art contain certain elements which preclude straightforward integration of these advantageous aspects.

None of the above electro-mechanical automatic airgun methods suggest provisions for launching pellets (as defined herein) or otherwise non-round projectiles in a fully-automatic fashion.

Therefore, regardless of the approaches, all of the prior methods have significant shortcomings, drawbacks, and limitations. It must be additionally noted that most implementations are more complex and intricate than the basic methods recounted, which indicates additional inelegance and shortcomings of the prior art.

In specific application domains, the extremely limited examples of action-cycling pre-charged fully-automatic BB/pellet airguns is a testament to the difficulty in cost-effectively creating such devices and is largely due to the inherent complexities when compared to their single-shot and semi-automatic counterparts.

As noted, prior art embodiments of particular individual classes of airguns as described above are typically generally similar to each other within each class, but are further modified in each individual embodiment to improve performance, simplify construction, lower cost, and/or to achieve other purposes; all known prior art has not been entirely satisfactory in some aspects. As such, the overall automatic airgun domain is largely confined to complex, intricate, and expensive paintball guns or low-powered, electro-mechanical airsoft guns with few exceptions. Accordingly, a need exists for automatic airgun methods and apparatuses which deliver improved performance, reduced complexity, simplified construction, less expensive manufacture, more flexibility, wider applicability, and greater reliability.

Therefore, while preexisting airgun methods may be suitable for the purposes for which they where designed, they would not be as suitable for the purposes of the present invention as heretofore described. In conjunction with and in addition to the drawbacks already noted, the prior art fails to satisfy all the needs in the art and is not suitable for the purposes of the present invention; as such, improved methods and mechanisms are required to alleviate continuing deficiencies.

SUMMARY

The following presents a simplified summary of some embodiments of the invention in order to provide a basic understanding of some aspects of the invention. This summary is not an extensive overview; it is neither intended to identify key or critical elements of the invention nor delineate the scope of the invention. Its purpose is to present some concepts of the invention in a simplified form as a prelude to a more detailed description presented later.

In accordance with one aspect of the present invention, one example embodiment overcomes some shortcomings of the prior art by utilizing a novel combination and arrangement of valve means and control means, where the valve actuator (a solenoid in this particular example embodiment) resides in what comprises an expansion chamber for (or within the reservoir of) the propellant, thereby eliminating the need for additional linkages, impact surfaces, additional actuator seals, or sliding seals for communicating actuator force to the valve and thereby also eliminating potentially complex propellant delivery ports and sealing pistons. The valve in this example embodiment can be simple and/or any suitable type that seals the breech from the propellant; this configuration can provide for both low cost and low dead-space. No bolt is employed in this particular example which can further simplify the implementation. In this particular embodiment, valve activation, dwell time, and cycle rate are controlled by an electronic circuit which may be low cost (one example embodiment of which is also provided). In this particular example, there is no additional obstruction to the propellant flow, and in conjunction with relatively low dead space and electronic control of the valve, comparatively higher performance and greater efficiency may be achieved from a particular propellant.

In accordance with another aspect of the present invention, another example embodiment overcomes some shortcomings of the prior art by utilizing a novel combination and arrangement of valve means and control means, where the valve actuator (solenoid in this particular example embodiment) resides in what comprises an expansion chamber for (or within the reservoir of) the propellant, thereby eliminating the need for additional linkages, impact surfaces, additional actuator seals, or sliding seals to communicate actuator force to the valve and thereby also eliminating potentially complex propellant ports and sealing pistons. The valve in this example embodiment can be simple and/or any suitable type that seals the breech from the propellant; this configuration can provide for both low cost and low dead-space. A spring-loaded bolt is employed in this particular example which retracts with the input propellant pressure and returns via the spring force; this bolt may be used to help sequence/feed the projectiles and/or restrict or block the propellant from entering the magazine, if desired. In this particular embodiment, valve activation, dwell time, and cycle rate are controlled by an electronic circuit which may be low cost (one example embodiment of which is also provided). In this particular example, there is no additional obstruction to the propellant flow, and in conjunction with relatively low dead space and electronic control of the valve, comparatively higher performance and efficiency can be achieved from a particular propellant.

In accordance with yet another aspect of the present invention, another example embodiment overcomes some shortcomings of the prior art by utilizing a novel electronic control circuit which controls the valve actuation, dwell time, and cyclic rate. This circuit can be relatively low cost and simple and/or any suitable control circuit.

As will become evident in the foregoing detailed description, some embodiments can practice the method with one moving part, no sliding seals, and simple projectile magazines, whereas other embodiments may utilize simple bolt feed mechanisms with a relatively limited parts count, and still other embodiments may take other forms, including (but not limited to) all mechanical versions and/or versions where the actuator linkage resides outside the expansion chamber and/or airgun body, for example. Thus, in accordance with the present invention, there are provided some example embodiments as summarized above.

The following detailed description is not to be construed in a limiting sense; the sample embodiments are only representative examples and do not define nor limit the scope of the present invention.

DRAWINGS

DESCRIPTION

Figure 1:
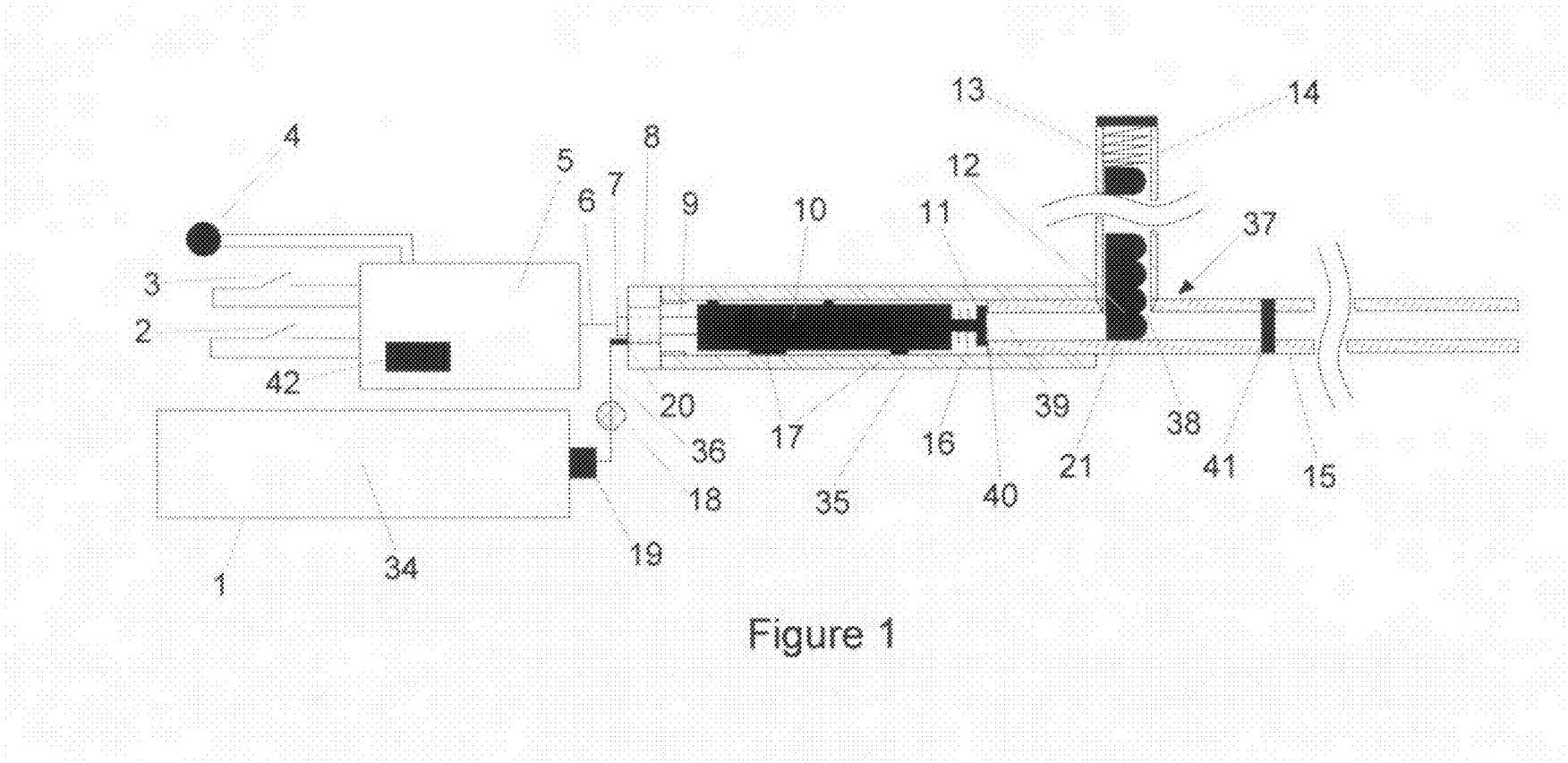
FIG. 1 is a cross sectional side view depicting one possible functional embodiment constructed in accordance with my invention.

FIG. 1 is a cross-sectional view depicting the right side of one possible functional embodiment of a device constructed in accordance with this invention. Main tank 1 contains a suitable propellant 34, which would typically be a compressed gas (such as air, CO2, helium, and so forth). Propellant 34 feeds into receiver assembly 35 through regulator/valve 18, gas tube 36, and gas port 20. Barrel 15 is a tube of suitable material (such as steel, aluminum, etc.) of a selected design diameter (i.e., projectile caliber) and a selected length, as dictated by the specific application, and connected to transfer assembly 37 via a smoothly-aligned, gas tight connector 41. Gas tight connector 41 provides a strong, rigid mechanical connection between barrel 15 and transfer assembly 37 and may be any suitable threaded connector, or welded or otherwise affixed sleeve or other connector, or in some instances barrel 15 and transfer assembly 37 may be machined as a single piece Ammo holder 14 holds projectiles 12 under tension by ammo holder spring 13. Ammo holder 14 can be inserted into a slot machined into transfer assembly 37, fitting flush with the transfer assembly as not to protrude into feed port 38 and making a gas tight seal with the transfer assembly. Projectile seat 21 may be a small indentation (such as a divot) which allows the projectile to sit more securely in transfer assembly 37; the size and/or depth of this seat depends on the specific projectile and other parameters of the system, and may be omitted in some implementations. Power wires 6 are connected from control circuit 5 to solenoid connector 7. Trigger switch 2, selective fire switch 3, and rate rheostat 4 are electrically connected via wires to control circuit 5. Solenoid connector 7 is mounted in a gas tight fashion through a hole in receiver closure 8 (which may be a threaded bolt or other suitable closure). Solenoid wires 9 are connected to solenoid connector 7 to enable an electrical connection from solenoid 10 to the solenoid connector 7. Solenoid 10 is mounted in receiver assembly 35 via solenoid mounts 17; these solenoid mounts do not significantly obstruct the airflow through receiver assembly 35. Solenoid plunger 11 slides into solenoid 10 and has a head which is larger diameter than the gas transfer port 39. Valve seal 40 is attached to solenoid plunger 11 in a fashion which seals gas transfer port 39. Solenoid spring 16 is a compression spring (of strength dictated by the system parameters such as projectile diameter, pressure, and so forth) placed between the housing of solenoid 10 and the head of solenoid plunger 11 which pushes solenoid plunger 11 and attached valve seal 40 against gas transfer port 39. Power supply 42 is a suitable battery pack or other power source that powers control circuit 5 and (through control circuit 5) solenoid 10.

Figure 2:
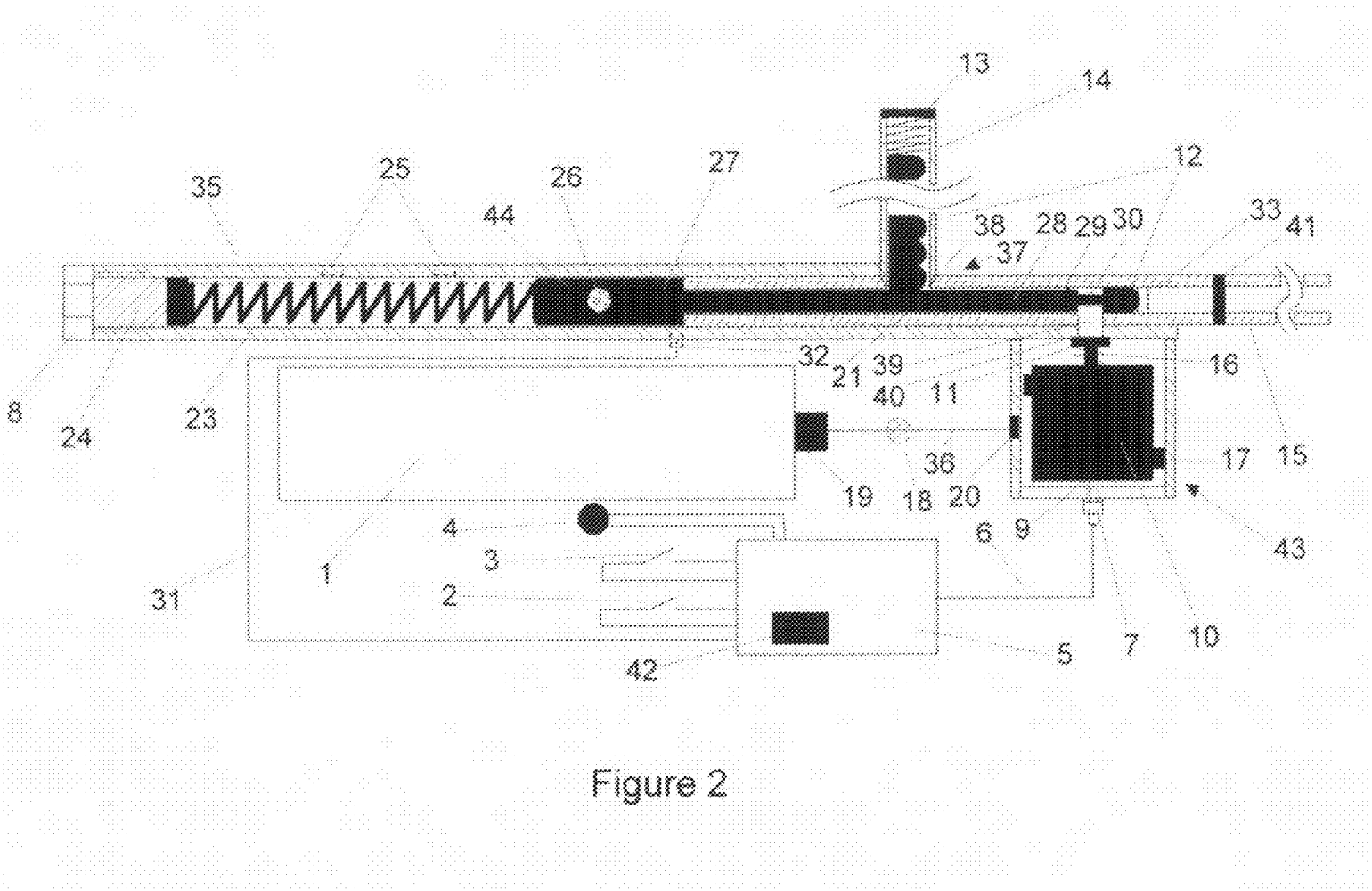
FIG. 2 is a cross sectional side view depicting one possible functional embodiment constructed in accordance with my invention.

FIG. 2 is a cross-sectional view depicting the right side of one possible functional embodiment of a device constructed in accordance with this invention. Main tank 1 contains a suitable propellant 34 which would typically be a compressed gas (such as air, CO2, helium, and so forth). Propellant 34 feeds into solenoid assembly 43 through regulator/valve 18, gas tube 36, and gas port 20. Barrel 15 is a tube of suitable material (such as steel, aluminum, etc.) of a selected design diameter (i.e., projectile caliber) and a selected length, as dictated by the specific application, and connected to transfer assembly 37 via a smoothly-aligned, gas tight connector 41. Gas tight connector 41 provides a strong, rigid mechanical connection between barrel 15 and transfer assembly 37 and may be any suitable threaded connector, or welded or otherwise affixed sleeve or other connector, or in some instances barrel 15 and transfer assembly 37 may be machined as a single piece. Ammo holder 14 holds projectiles 12 under tension by ammo holder spring 13. Ammo holder 14 can be inserted into a slot machined into transfer assembly 37, fitting flush with the transfer assembly as not to protrude into feed port 38. Projectile seat 21 may be a small indentation (such as a divot) which allows the projectile to sit more securely in the transfer assembly 37; the size and/or depth of this seat depends on the specific projectile and other parameters of the system, and may be omitted in some implementations. Retaining sleeve 33 is a flexible ring made from metal, plastic, rubber, or other suitable material and may be omitted in some implementations. Power wires 6 are connected from control circuit 5 to solenoid connector 7. Trigger switch 2, selective fire switch 3, and rate rheostat 4 are electrically connected via wires to control circuit 5. Solenoid connector 7 is mounted in a gas tight fashion through a hole in solenoid assembly 43. Solenoid wires 9 are connected to solenoid connector 7 to enable an electrical connection from solenoid 10 to the solenoid connector 7. Solenoid 10 is mounted in solenoid assembly 43 via solenoid mounts 17; these solenoid mounts do not significantly obstruct the airflow through solenoid assembly 43. Solenoid plunger 11 slides into solenoid 10 and has a head which is larger diameter than the gas transfer port 39. Valve seal 40 is attached to solenoid plunger 11 in a fashion which seals gas transfer port 39. Solenoid spring 16 is a compression spring (of strength dictated by the system parameters such as projectile diameter, pressure, and so forth) placed between the housing of solenoid 10 and the head of solenoid plunger 11 which pushes solenoid plunger 11 and attached valve seal 40 against gas transfer port 39. Power supply 42 is a suitable battery pack or other power source that powers control circuit 5 and (through control circuit 5) solenoid 10. Loading bolt 28 is either affixed or machined to bolt block 27; it is inserted into receiver assembly 35, whereby loading bolt 28 slides into the rear portion of transfer assembly 37 forming a reasonably gas-tight sliding seal with transfer assembly 37. Optional bolt o-ring 29 may assist in sealing, if required, or may be omitted. Bolt spring 23 is a compression spring that is inserted into receiver assembly 35 between bolt block 27 and bolt stop 24. Bolt stop 24 is secured in place via receiver closure 8 which may be a threaded bolt or other suitable closure. Vent holes 25 are optional slots in receiver assembly 35 depending on the implementation. Bolt handle 26 attaches to bolt block 27 and protrudes through the body of receiver assembly 35 through bolt handle slot 44. Bolt handle slot 44 is cut into receiver assembly 35 and allows bolt handle 26 (along with attached bolt block 27 and loading bolt 28) to slide backwards in receiver assembly 35 to bolt stop 24.

Figure 3:
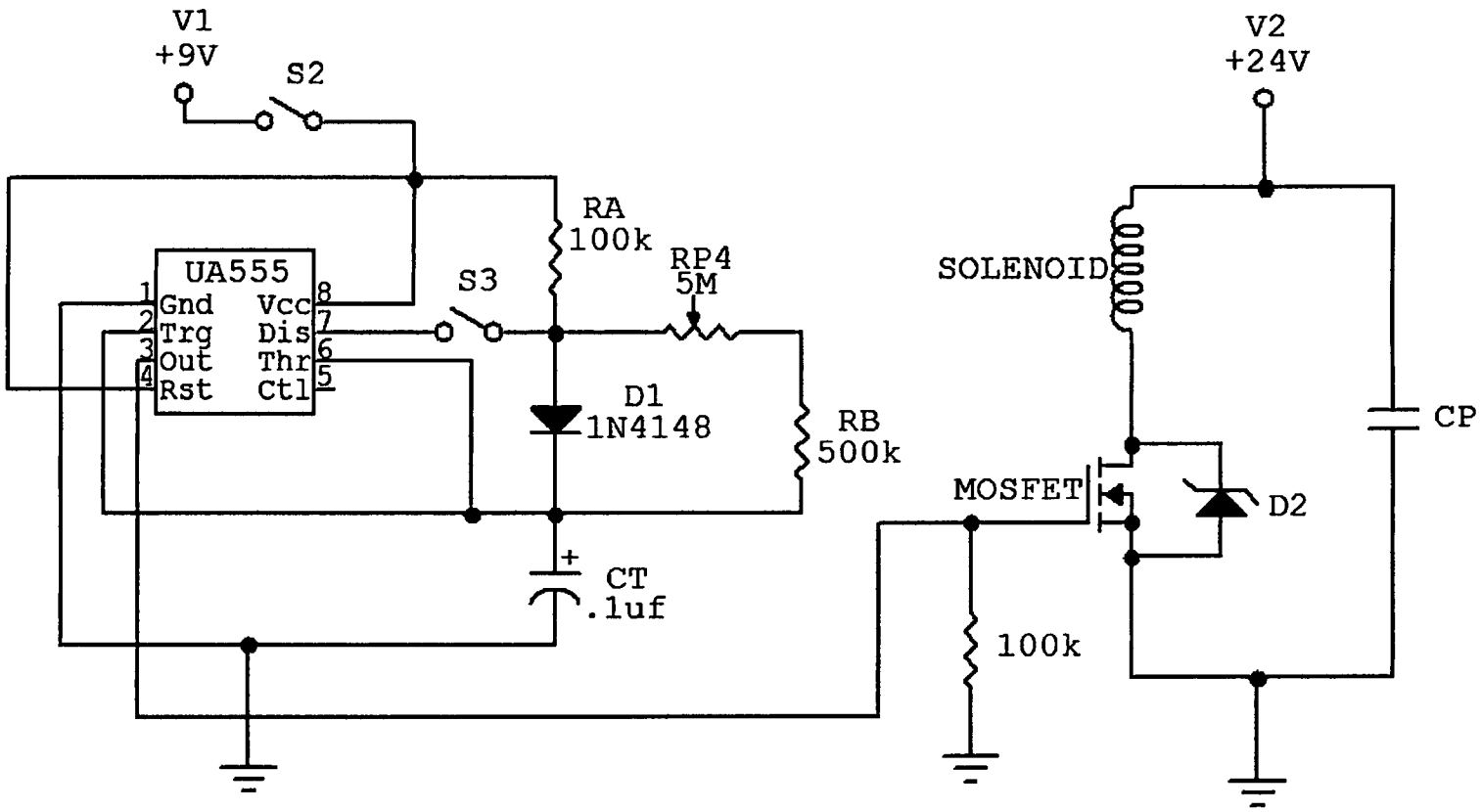
FIG. 3 depicts one possible control circuit example.

FIG. 3 depicts one possible control circuit example. A 555 timer IC in conjunction with connected timing components RA, RB, RP4, CT form a pulse generator with a specific duty cycle. Diode D1 is used to allow the 555 duty cycle to be less than 50%. In this particular implementation example, the component values are RA=100K, RB=500K, RP4=5M, and CT=0.1 uf; D1 is any suitable signal diode, such as the 1N4148. The output of the timer section is taken from pin 3 of the 555 and is applied to the gate of the MOSFET. The MOSFET is connected to the solenoid in a fashion to allow switching of power to the solenoid. The capacitor is either a single capacitor or capacitor bank that augments the power supply to provide additional driving current to the solenoid. D2 is a freewheel diode that may be intrinsically part of the power MOSFET itself. The solenoid, MOSFET, capacitor, and voltage values (V1,V2) depend on the specific application. A pull-down resistor RG may be added to the gate of the power MOSFET for added reliability; this insures that the gate is held low when the 555 is not powered. As one specific example, for instance, one particular configuration may have a 0.65 ohm solenoid coil with ~10 mH or other suitable inductance (with ferrous plunger inserted), an IRF3205 (or equivalent) MOSFET (with proper heat-sink), and a 60V 2000 uF capacitor bank CP, operating up to 48V (24V is shown on the figure), whereby the operating pressure is up to 300PSI or any other operating pressure that is within the capabilities of the circuit to reliably open the valve and cycle the action.

Figure 4:
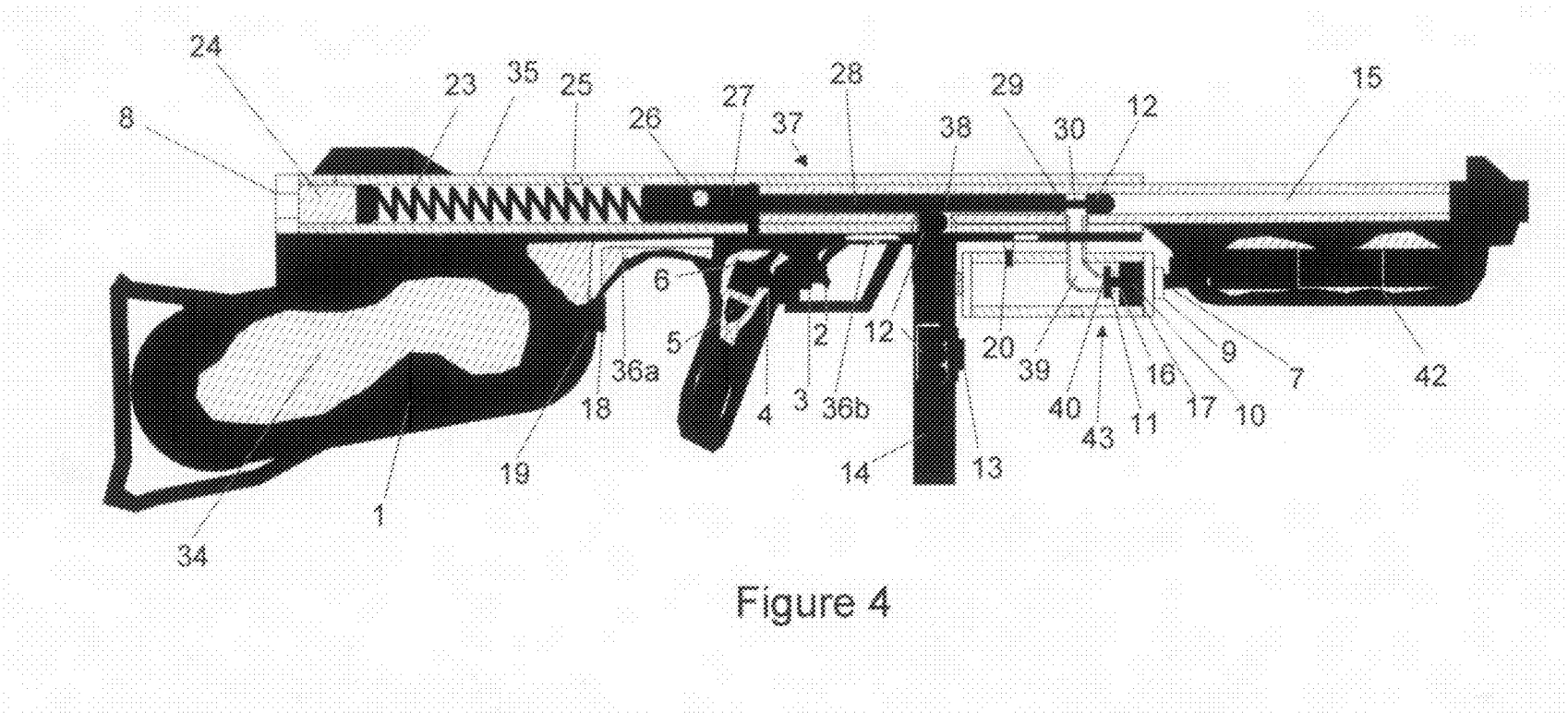
FIG. 4 depicts a side view of one arrangement in accordance with the functional view depicted in FIG. 2, but in a possible commercial form.

FIG. 4 depicts a side view of one arrangement in accordance with the functional view depicted in FIG. 2, but in a possible "commercial" form. A similar configuration could also be used for the functional view depicted in FIG. 1, with the exclusion of the bolt and a repositioning of the ammo holder. The description is identical to that of FIG. 2, with the exception that the layout of the components is more ergonomic; and some traditional ergonomic items (i.e., handle, fore-grip, sights and so forth) have been added. All dimensions depend on the specific application; similarly, the positioning of components, such as the barrel start position and loading bolt, may be adjusted as to provide better performance characteristics and/or ergonomics, and so forth. The overall construction of the transfer assembly and valve components are the same as that in FIG. 1 and FIG. 2. Gas tube 36 is depicted as 36*a* and 36*b* namely so that the gas tube 36 routing may be more easily traced in the figure. Power supply 42 has been positioned in the fore-grip. In this embodiment, ammo holder 14 is shown as a drum with ammo holder spring 13 being a drum spring, but may also be a stick/box magazine or other suitable ammunition holder such as a belt with a feeder.

Materials and Sub-Components

The materials used in construction should be suitable to handle the pressures and temperatures in various parts of the device. For instance, if the pressure in the transfer assembly is 5,000 psi, it must be able to handle this pressure, plus any margin and safety factors. Because of the wide range of pressures that could be chosen, materials selection will be largely a function of the application of the unit and the specific design choices. For instance, a recreational and/or non-lethal device which shoots BBs (and/or some other form of projectiles at relatively low velocity) could potentially have relatively low pressure requirements (possibly 300 psi, for example); this may allow for a lower material strength requirement; a high velocity unit may require exceptionally strong materials, and so forth.

As described, material selection is highly dependent on the specific application, pressure selection, operational requirements, and other factors. As an example (and this is by no means inclusive of all possible materials), embodiments could use 1118 steel (or even some aluminum alloys) for the barrel, stainless, mild steel or possibly copper or a suitable aluminum alloy for the transfer assembly, hardened 1040 steel for the bolt, common spring steel for the compression springs, steel or high strength aluminum for the receiver, neoprene for the valve seal; steel braided lines and/or direct connections for the gas tubes, carbon-fiber metallic lined composite tanks at the high-end to simple plastics at the low-end for the compressed propellant, assorted mild steels and/or aluminum for the interconnecting components, tool-grade lithium-ion to standard alkaline batteries, and optional capacitors for the control circuit.

Components may be standard or custom micro-switches for the trigger and bolt switch (of any suitable design including, but not limited to, mechanical, magnetic, or optical devices), standard or customized rheostats for the rate selector. Materials such as thin mild steel or aluminum may be used for the ammo holder which is constructed in a similar fashion to traditional cartridge based clips/magazines/drums and/or other projectile feed mechanisms with the exceptions as noted. The projectiles may be constructed from any suitable material, depending on the application, including hard materials such as depleted uranium, lead, bismuth, steel, etc., as well as softer materials such as rubber, sponge, plastic, wood, etc., and/or anything else or combination thereof. Projectiles, including standard shot, grenade/exploding rounds, thermobarics, seekers, multi-pellet shot, slugs, non-lethal shot, and other types of projectiles could also be used depending on the application. All materials listed in this document are by no means inclusive of all such materials that could be used in the construction of the device, and such will be dependent on the specific application, implementation, and corresponding requirements.

Dimensions

As noted, the dimensions are highly dependent on the specific application and design requirements, and can vary greatly within the same basic functional type of embodiment. For example, and this is by no means inclusive, the embodiment in FIG. 1 may use a 12" long barrel (say as measured from the rear of the loaded projectile to the muzzle) of 0.177 caliber, and a 5" long by 0.5" diameter solenoid (plunger-electromagnetic type, for instance) with 0.25" diameter plunger and an operating pressure of 250 psi or other suitable pressure. Or, it could use a 24" long barrel of 0.22 caliber, and a 8" long by 1.5" diameter solenoid with a 0.5" diameter plunger, and an operating pressure of 800 psi or other suitable pressure. Note that the materials (and material dimensions) in each case would need to be appropriate for the design pressures; the solenoid valve system, control circuit, and power would likewise need to be adequate to open the valve, and functional components would be chosen accordingly. Such dimensions are some general examples for embodiments depicted in both FIG. 1 and FIG. 2, adjusting for the few self-evident differences between them. For example, the barrel may be measured from the rear of the loaded projectile to the muzzle in all embodiments, but these actual locations may be different in the embodiments due to the presence (or absence) of the loading bolt. Again, these are just examples and such dimensions are highly dependent on the application and specific design requirements.

The main tank may be any suitable tank (or any plurality of tanks acting as a main tank) for the specific application and required pressures; for instance, tanks may range from 0.3 L to 3 L and from 50 PSI to 10000 PSI, but these ranges are an example and are by no means inclusive to all sizes or pressure ranges that main tanks may actually have.

Operation

Operation of Embodiment #1

Reference FIG. 1 when following the operation of this example, except where noted.

In operation, the user loads ammo holder 14 with projectiles 12, similar to loading a magazine/clip in a traditional cartridge-based firearm; in this embodiment, the ammo holder may be gravity-fed (for example, top mounted) and/or spring fed, gas fed, or other system. In this particular embodiment, the ammo holder is a retainer-free magazine/clip whereby the projectiles are allowed to freely enter feed port 38 and transfer assembly 37 (via applied force from the ammo holder spring 13) rather than being retained by the ammo holder and subsequently force loaded by the bolt (although this is another possible mode). One loads a propellant 34 into main tank 1, via pump/compressor or other suitable means up to a specified design pressure which is dependent upon the specific application. For descriptive purposes of this embodiment, the propellant may be compressed air, but could also be any suitably compressible fluid that is compatible with the tank and the propellant delivery mechanisms (including the regulators and valves). Such propellants include (but are not limited to) air, $CO_2$, nitrogen, nitrous oxide, helium, hydrogen, propane, and so forth.

The populated ammo holder 14 is inserted into transfer assembly 37 (and/or receiver assembly 35 depending on the specific construction) and secured via a traditional magazine latch or other mechanism. In this particular embodiment the magazine connection forms a gas tight seal with the transfer assembly 37. The ammo holder spring 13 is released, allowing the projectiles to move upwards by the force of the ammo holder spring. Propellant valve 18 is opened, filling receiver assembly 35 through gas port 20 via regulator 19 up to the regulator pressure. As noted for this embodiment, compressed air may be used as the propellant. The operating pressure is application dependent and is based on the desired muzzle velocity, caliber, valve port (i.e., gas transfer port) dimensions, and other parameters.

At this point, the device is ready to launch a projectile (it needs no cocking). Launching the projectile is accomplished by activating (closing) trigger switch 2; the logic in control circuit 5 senses this switch state and activates a logical pulse train that is determined by the design of the circuit and any external settings (in this case, selective fire switch 3 and rate rheostat 4). The logical pulses are converted to high current output pulses by means of a suitable amplification device that provides enough current to power solenoid 10 as per the specifications of the application. In this embodiment, control circuit 5 is based on a 555 timer and MOSFET amplifier (see FIG. 3), but may be any suitable circuit that accomplishes the task. The high current output drives pulse wires 6, which are connected to solenoid 10 via solenoid connector 7 and solenoid wires 9. Each pulse thus energizes the solenoid, pulling the plunger in against the force of the gas pressure and spring (and possibly gravity), which was previously sealing gas transfer port 39 via valve seal 40, these components thus forming a valve operated by solenoid 10. This unsealing allows the propellant to expand and enter gas transfer port 39, which then rapidly fills the transfer assembly. As the pressure builds in the transfer assembly, the projectile in the transfer assembly is subject to a force in line with barrel 15, and the projectile stack in ammo holder 14 is subject to a force in line with the ammo holder; this causes the projectile in the transfer assembly to be accelerated through remainder of the transfer assembly and into the barrel, and the projectile stack in the magazine to be forced towards the spring.

The duration and strength of the pulse controls how fast the valve seal opens, how far the valve seal opens, and how long the valve seal stays open (dwell time); these attributes depend on the specific application and can be tuned by the design of control circuit 5. For example, in this embodiment, the valve timing may be tuned to stay open for 2 ms or some other duration. As the projectile is accelerated down the barrel and the projectile stack is forced against the spring, the next projectile cannot enter the transfer assembly until the spring force overcomes both the inertia of the projectile stack and the force of the propellant in the transfer assembly pushing on the projectile stack. As the projectile moves through the barrel the valve closes at the designed time (via valve spring 16 and valve seal 40, resealing gas transfer port 39), and the pressure in the barrel and transfer assembly start to decrease, until the projectile escapes the barrel and the pressure in the barrel and transfer assembly drop rapidly. The pressure on the projectile stack is now greatly reduced and after any projectile stack inertia is overcome, the ammo holder spring 13 forces the stack back towards feed port 38, pushing the next projectile into launching position.

If the selective fire switch 3 is set on "semi-automatic," then control circuit 5 will not issue another pulse until trigger switch 2 is released and reactivated, upon which time the cycle will repeat, launching another projectile. If the selective fire switch 3 is set on "fully-automatic," then control circuit 5 will issue pulses a a rate dependent on the design of control circuit 5 and rate rheostat 4. For instance, 960 rounds per minute equates to 16 rounds per second, or control circuit 5 issuing a pulse every 62.5 ms. If the valve is to be open for 2 ms, for example, then the pulse length may require adjustment to 5 ms, 10 ms, or some other value to account for the mechanical opening time, solenoid activation time, and so forth. Solenoid 10, solenoid plunger 11 and solenoid spring 16 must be selected/designed to handle the required mechanical time constants in order to achieve the desired firing rates in any specific application; if they are too massive and/or the spring is poorly chosen, the frequency of the plunger action will not be able to keep up with the electrical pulses; less massive components allow for faster response times.

Note that ammo holder spring 13 must be strong enough to feed the projectile stack at the desired firing rate, but not so strong as to feed the next projectile into the feed port early (i.e., before the previous projectile has left the barrel). If this occurs, the next projectile may be prematurely launched from the barrel (most likely at a significantly reduced velocity). Note that the projectile stack will not completely seal the ammo holder and thus propellant will leak into the ammo holder itself, thereby reducing pressure on the stack (and possibly allowing the propellant gas to actually force the stack back toward the feed tube in some implementations); if the device and/or ammo holder is improperly adjusted and/or constructed, this may result in the early loading of subsequent projectiles. Thus, in this particular embodiment, insuring that the projectiles form a relatively good seal with the ammo holder, while still insuring that they feed properly via the ammo holder spring, and/or insuring that there is no possibility of early loading due to operating pressures and/or ammo holder spring selection, may result in improved reliability and/or performance. Component selection depends on the specific application, and will depend on calibers, pressures, and other factors.

Operation of Embodiment #2

Reference FIG. 2 when following the operation of this example, except where noted.

In operation, the user loads ammo holder 14 with projectiles 12, similar to loading a magazine/clip in a traditional cartridge-based firearm; in this embodiment, the ammo holder may be gravity-fed (for example, top mounted) and/or spring fed, gas fed, or other system. In this particular embodiment, the ammo holder is a retainer-free magazine/clip whereby the projectiles are allowed to freely enter feed port 38 and transfer assembly 37 (via applied force from the ammo holder spring 13) rather than being retained by the ammo holder and subsequently force loaded by the bolt (although this is another possible mode). One loads a propellant 34 into main tank 1, via pump/compressor or other suitable means up to a specified design pressure which is dependent upon the specific application. For descriptive purposes of this embodiment, the propellant may be compressed air, but could also be any suitably compressible fluid that is compatible with the tank and the propellant delivery mechanisms (including the regulators and valves). Such propellants include (but are not limited to) air, CO2, nitrogen, nitrous oxide, helium, hydrogen, propane, and so forth.

The populated ammo holder 14 is inserted into transfer assembly 37 (and/or receiver assembly 35 depending on the specific construction) and secured via a traditional magazine latch or other mechanism. In this particular embodiment the magazine connection forms a gas tight seal with the transfer assembly 37. The ammo holder spring 13 is released, allowing the projectiles to move upwards by the force of the ammo holder spring. Propellant valve 18 is opened, filling solenoid assembly 43 assembly through gas port 20 via regulator 19 up to the regulator pressure. As noted for this embodiment, compressed air may be used as the propellant. The operating pressure is application dependent and is based on the desired muzzle velocity, caliber, valve port (i.e., gas transfer port) dimensions, and other parameters.

The device is then cocked by pulling bolt 28 toward the back of the device via bolt handle 26. This allows the stack of projectiles 12 to move (as it is no longer blocked by bolt 28) and pushes one of the projectiles through feed port 38 and into the loading position. Allowing bolt 28 to slide forward pushes the available projectile from this loading position to a position beyond gas transfer port 39. The shape of the bolt face 30 can also allow a small gap between the projectile and the bolt for a gas path. The device is now primed, armed, and ready to fire.

At this point, the device is ready to launch a projectile. Launching the projectile is accomplished by activating (closing) trigger switch 2; the logic in control circuit 5 senses this switch state and activates a logical pulse train that is determined by the design of the circuit and any external settings (in this case, selective fire switch 3 and rate rheostat 4). The logical pulses are converted to high current output pulses by means of a suitable amplification device that provides enough current to power solenoid 10 as per the specifications of the application. In this embodiment, control circuit 5 is based on a 555 timer and MOSFET amplifier (see FIG. 3), but may be any suitable circuit that accomplishes the task. The high current output drives pulse wires 6, which are connected to solenoid 10 via solenoid connector 7 and solenoid wires 9. Each pulse thus energizes the solenoid, pulling solenoid plunger 11 in against the force of the gas pressure and spring (and possibly gravity), which was previously sealing gas transfer port 39 via valve seal 40, these components thus forming a valve operated by solenoid 10. This unsealing allows the now expanding propellant to enter gas transfer port 39, which then rapidly fills the transfer assembly area between bolt 28 and the projectile. As the pressure builds in the transfer assembly, the projectile in the transfer assembly is subject to a force in line and towards barrel 15, and the bolt 28 is subject to a force in the opposite direction; this causes the projectile in the transfer assembly to be accelerated through remainder of the transfer assembly and into the barrel, and the bolt to be driven rearwards, thereby compressing bolt spring 23. Optional vents 25 in receiver assembly 35 prevent air trapped behind bolt block 27 from delaying the action; typically, these would not be required as bolt handle slot 44 provides adequate venting.

The bolt can be significantly more massive than the projectile (for instance, maybe 40× but this depends largely on the selection of the ammunition, designed repetition speed, and other design choices); bolt 28 is also supported by bolt spring 23. Thus, the bolt has a slow rate of travel backwards compared to the forward projectile motion and the projectile leaves the barrel far before the bolt has moved a significant distance. For instance, a bolt 40× more massive then the projectile will accelerate 40× slower under the same force. As both the bolt and projectile are subject to the same force in this embodiment (initially neglecting the spring), and acceleration is inversely proportional to the mass, the velocity, v=at, will be proportional to the average force as v=(F/m)t, or distance=(0.5)(F/m)t^2. During some time interval 't', the distance is simply a function of the force and mass. In this particular implementation, the force is the same for both the bolt and the projectile and thus the distance is in linear inverse proportion to the mass. As such, a 40× greater bolt will travel $1/40^{th}$ the distance in the same time period. In the time period it takes the projectile to traverse a 12" barrel, for instance, the bolt would have traveled 0.3." The force on the bolt after the projectile leaves the barrel is primarily the force of bolt spring 23 alone, since the remaining pressure is quickly vented through the barrel. The force of the bolt spring 23 must then overcome the backwards momentum of the bolt to cycle the action. Thus, the spring is chosen to allow effective cycling of the action, allowing the bolt to retract back to the bolt stop 24 (or, if desired, some intermediary point). By adjusting the spring tension, bolt length, ammo feed position, and the gas port position, it is possible to design devices with wide velocity ranges that can still reliably cycle. A particular bolt spring, for instance, could allow a reasonably heavy bolt to retract all the way to the stop under less force, resulting in enabling lower velocity projectiles while still effectively cycling the action. The lower retraction speed of the bolt (and reasonable gas-tight sliding seal between the bolt and the transfer assembly, with optional bolt o-ring 29, if required for performance) prevents propellant from reaching ammo holder 14 or other areas in receiver assembly 35 until the pressure drops considerably. In some cases, optional vents 25 may by used to help insure there is no pressure buildup inside the upper receiver, however bolt handle slot 44 used for bolt handle 26 in the receiver will typically be adequate for venting.

The duration and strength of the pulse controls how fast the valve seal opens, how far the valve seal opens, and how long the valve seal stays open (dwell time); these attributes depend on the specific application and can be tuned by the design of control circuit 5. For example, in this embodiment, the valve timing may be tuned to stay open for 2 ms or some other duration. As the projectile moves through the barrel, the valve closes at the designed time and the pressure in the barrel and transfer assembly start to decrease, until the projectile escapes the barrel and the pressure in the barrel and transfer assembly drop rapidly. Note that as the projectile is accelerated down the barrel the bolt is driven rearward, but the next projectile cannot enter the transfer assembly until the bolt moves clear of the feed port, thereby unblocking the projectile stack and allowing the ammo holder spring to force the projectile stack downwards. As described, the timing of the bolt clearing the feed port would normally be designed to occur after the projectile had left the barrel (and thus also after the valve closed), and after the pressure in the transfer assembly had become close to ambient (or acceptably low). After the projectile leaves the barrel, the bolt continues rearwards on its own inertia, eventually passing the feed port (thus unblocking the projectile stack as described earlier and allowing a projectile to move into the loading position) and continues rearward until its inertia is overcome by bolt spring force or it reaches the bolt stop; in either case the bolt spring will force the bolt forward again, thereby pushing the projectile in the transfer assembly from the loading position into the launching position, ready for the next cycle.

If the selective fire switch 3 is set on "semi-automatic," then control circuit 5 will not issue another pulse until trigger switch 2 is released and reactivated, upon which time the cycle will repeat, launching another projectile. If the selective fire switch 3 is set on "fully-automatic," then control circuit 5 will issue pulses a a rate dependent on the design of control circuit 5 and rate rheostat 4. For instance, 960 rounds per minute equates to 16 rounds per second, or control circuit 5 issuing a pulse every 62.5 ms. If the valve is to be open for 2 ms, for example, then the pulse length may require adjustment to 5 ms or some other value to account for the mechanical opening time, solenoid activation time, and so forth. Solenoid 10, solenoid plunger 11 and solenoid spring 16 must be selected/designed to handle the required mechanical time constants in order to achieve the desired firing rates; if they are too massive and/or the spring is poorly chosen, the frequency of the plunger action will not be able to keep up with the electrical pulses; less massive components allow for faster response times. Note that the entire cyclic action of bolt 28 (completed when the bolt has finished pushing the subsequent projectile into the launching position) must complete before the next pulse is initiated to insure reliable cycling of the action; thus, in the particular timing example introduced above, the bolt must return to its forward most position in less than 62.5 ms after a trigger pulse is initiated.

Note that ammo holder spring 13 must be strong enough to feed the projectile stack at the desired firing rate, but not so strong as to place undue pressure on the bolt. If this occurs, the friction will overtly impair the bolt travel and may lead to unreliable cycling of the action.

Note that ammo holder 14 does not need to be sealed since the bolt prevents propellant from reaching the interior of the ammo holder or projectile stack. Thus, in this particular embodiment (as opposed to embodiment #1) there is less need for the projectiles to form a relatively good seal with the ammo holder and it is possible not to have the ammo holder sealed; such may result in improved reliability and/or performance. Note that, as an option, feedback from the bolt position can be used to trigger control circuit 5 via optional bolt switch 32. This data can be used in several ways, for example, bolt switch 32 may be placed in series with trigger switch 2 through control circuit 5, and control circuit 5 may comprise a single-shot pulse circuit which is activated by the closure of both bolt switch 32 and trigger switch 5; in such a case, cyclic rate and timing could be handled primarily by the bolt action. While this may not always be desirable, there may be certain applications which can benefit—for example, a control circuit can be made whereby the reciprocating bolt action and bolt switch (in conjunction with the trigger switch) could be used to trigger the circuit directly (and/or via capacitive discharge), possibly allowing removal of some of the discrete electronic components. Another possible use of bolt switch 32 is to insure that the bolt is in the proper position before allowing control circuit 5 to send a pulse, thereby helping to insure reliable cycling. Component selection depends on the specific application, and will depend on calibers, pressures, and other factors.

Optional retaining ring 33 may be used to seat and retain the loaded projectile, if desired. This is advantageous when the barrel fit may be loose enough or otherwise have low enough friction to allow the projectile to shift position too easily. In this case, the action of loading bolt 28 may force the projectile too far into the barrel, or the projectile may otherwise shift from its loaded position with motion of the device. Retaining ring 33 can help prevent this by allowing loading bolt 28 to push the projectile into a retaining seat that may also be flexible (depending on the projectile material). Note that proper barrel design and other methods can also achieve the effect of a retaining ring, and that this is only one example of how positive projectile seating may be accomplished. For instance, if lead projectiles are used, a slightly tapered steel breech could achieve the same effect, where by the projectile itself is properly formed by being forced into the barrel.

Operation of Control Circuit

Reference FIG. 3 when following the operation of this example, except where noted.

The optional pulse capacitor C2 charges through the power supply V2 (shown as 24V in this circuit). The 555 timer IC in conjunction with components RA=100 k, RB=500 k, RP4=5M, CT=0.1 uF, and D1 as any suitable signal diode (such as the 1N4148, or others), create a pulse train on output pin 3 of the 555; repetition rate depends on RB, RP4, and CT (corresponding to approximately 50 ms per pulse when RB+RP4=720 k), each with an approximate 7 ms pulse width as controlled by RA and CT; when RB+RP4=720 k, the pulse train corresponds to roughly 1200 pulses per minute. D1 is used to allow the 555 duty cycle to be less than 50%. In this particular implementation, the 555 is powered via V1 (shown as 9V in this circuit, but can be any suitable voltage such as 12V or other, if required) which also relates to the voltage present on output pin 3 of the 555; TTL 555s will exhibit output voltages that are lower than V1 by about ~1.7 v, whereas CMOS 555s can drive the output to V1 but have reduced source/sink capabilities. TTL 555s are generally capable of 200 mA (source/sink) output which is enough to drive a MOSFET directly in some applications (namely where gate capacitance is manageable with the required switching speeds and device power demands), and such is used here for example (although the output could be buffered if required). Certain applications could use CMOS 555s if the selected MOSFET can be driven satisfactorily or an output buffer (such as a transistor) is used for additional driving current. The MOSFET selected depends on the particular solenoid, and how much current the coil requires to effectively pull the solenoid plunger (refer to solenoid 10 and solenoid plunger 11 in FIGS. 1 and 2). As one specific example, for instance, the solenoid may have a 0.65 ohm coil with ~10 mH (with ferrous plunger inserted) or other suitable inductance, the MOSFET an IRF3205 N-channel power MOSFET (or equivalent, heat-sinked), the capacitor CP 2000 uF, V1 generally up to 15V, the V2 voltage from 12V to 48V, and the operating pressure up to 300 PSI or any other pressure in which the solenoid and selected voltage are capable of opening the gas transfer port. When the gate is driven high via 555 output pin 3, the MOSFET device switches on; its resistance falls to a low value, allowing current to flow through the solenoid, both from the capacitor bank and power supply (the V2 component of the power supply and capacitor are in parallel). The capacitor bank is optional and is only required if the power supply itself does not possess enough current to effectively pull the solenoid plunger and unseal the gas transfer port at the required operating pressure; optionally, the capacitor bank may also be used to reduce the initial drain on the battery, possibly extending its useful charge and/or life. Once the port has opened, the force on the solenoid plunger acting against the pull force will reduce (as the gas is attempting to equalize), and the required holding current will also reduce; thus, a more moderate amount of current may suffice to achieve the desired dwell time. Although the MOSFET has been switched on, the rise time of the solenoid coil and the mechanical time required to open/unseal the gas transfer port due to the motion of the solenoid plunger do not allow these actions to happen instantly; thus, even though the pulse duration is about 7 ms in this example, the dwell time may be considerably different, and the open time may depend strongly on factors such as the solenoid itself and applied current. Tuning can be accomplished by adjusting the parameters of the circuit (including the duty cycle, voltage and current, capacitor bank, and so forth) and the mechanical aspects of the solenoid, solenoid plunger and other factors. As a note, in this particular example, the solenoid may, for instance, have a DC resistance of 0.65 ohms, resulting in a steady-state current draw of ~37 A at 24V. But, the actual current draw (current draw while the coil is powered during the pulse duration) depends on the rise time due to the solenoid coil inductance and may be significantly less than the steady-state value during the on-time of the MOSFET; thus, it is possible that this coil (and MOSFET) may never encounter above 15-20 A depending on the parameters of the application. Still, using components that are over-specified tends to increase reliability and reduces the size of the heat-sink required on the MOSFET. Also, a pull-down resistor RG may be added to the gate of the power MOSFET for added reliability; this insures that the gate is held low when the 555 is not powered. Note that operating pressures in the device should not exceed the ability of the solenoid to properly retract the solenoid plunger (and thus prevent unsealing the gas transfer port).

Trigger switch S2 (shown as trigger switch 2 in FIGS. 1 and 2) is implemented in a simplified fashion in this example, whereby it controls the power to the timer IC directly. This is reasonably acceptable here because of the relatively large activation times as compared to the circuit settling times. Similarly, selective fire switch S3 (shown as selective fire switch 3 in FIGS. 1 and 2) effectively removes RB from the circuit; this places the 555 into a type of one-shot mode whereby the 555 produces one pulse when powered; there are other ways to configure the 555 for this purpose. As noted, RB and RP4 (shown as rate rheostat 4 in FIGS. 1 and 2) adjust the pulse repetition rate; the specific components shown in this particular example allow a variance from roughly 160 to 1700 pulses per minute (which corresponds to ~160-1700 rounds per minute); these component values may be modified to deliver any appropriate range for proper and/or reliable functioning within the system. Optionally, RP4 (along with RB) may be replaced by a selected fixed value resistor, thereby also fixing the cyclic rate. D2 is a freewheel diode that prevents the inductive kickback of the solenoid coil from damaging the MOSFET; such a diode is often intrinsic to the MOSFET and thus an additional external diode is not required in some applications.

Non-Inclusive Alternative Variations/Modes and Options for Above Embodiments

1) Control Circuit Options

Control circuits ranging from 555 timer based circuits to more advanced micro-controller based units (or other types of designs) could be employed; optional selective fire settings may be added and/or be specific to the type of device constructed. For instance, it is possible to add multiple round "burst modes" by adding another timer circuit and electrically operated switch (such as using a MOSFET, relay, or other in such a configuration) in place of the existing trigger switch. In this case, the new timer circuit could be adjusted to activate the control circuit for a duration which provides launching of some specific number of rounds at some specific cyclic rate with one trigger activation, for instance. Going further, such burst-modes and other features, such as additional feedback sensors, could be readily implemented via micro-controller based control units under software control, or in some instances, several types of programmable logic devices.

2) Actuator and Control Options

The potential exists for substituting mechanical actuation and control mechanisms (rather than electronic control), if desired.

3) Magazine Flaps/Sequencers

Some embodiments may implement additional sequencers and/or magazine flaps to prevent propellant from entering the magazine and/or prevent projectiles from entering the breech prematurely, namely in bolt-free embodiments. Such may take the form of a component that slides partly into the breech or over the top of the magazine, possibly motivated to do so by propellant pressure (or possibly a solenoid), in such a fashion as to separate the loaded projectile from those in the magazine, and/or prevent propellant from entering the magazine.

4) Bolt Direction/Angle

Some embodiments may implement the bolt in such a fashion that the motion is perpendicular (or otherwise at some other angle) relative to the breech or barrel (it is shown as in-line with the barrel in the example embodiment #2). The basic operation of the unit remains identical, but could allow some embodiments to employ other form factors, plumbing arrangements, and so fourth. In addition, mounting the bolt perpendicular to the breech could potentially simplify retaining the projectile in the breech in some embodiments.

The example embodiments and alternative variations presented are in no way inclusive to all possible embodiments or variations in accordance with the invention, and are simply to provide representative examples in accordance with the invention.

Advantages

From the description above, a number of advantages for some embodiments of my automatic airgun method and apparatuses become evident—one or more advantages may include (but need not include nor are limited to):

(a) Allowing a simple automatic airgun method while providing straightforward implementation for both semi and fully-automatic modes (selective-fire).
(b) Allowing development and manufacturing costs due to reduced parts count and reduction in precision machining requirements.
(c) Potentially enabling the implementation of an automatic airgun with few custom made components and/or limited machining.
(d) Reducing or potentially eliminating critical sliding seals.
(e) Allowing for simpler valve options than in existing automatic airguns.
(f) Allowing for increased performance by potentially eliminating airflow obstructions and providing for greater flow coefficients, and potentially reducing dead-space due to flexibility in valve positioning.
(g) Providing for unlimited valve seat area dependent only on available activation power.
(h) Functioning with virtually any caliber projectile.
(i) Providing for adjustable rates-of-fire and adjustable velocity via electronic control means, if desired.
(j) Allowing implementations to largely decouple projectile velocity from the cycling rate.
(k) Providing flexibility in the control circuit and thereby allowing simple control electronics (such as switches and/or simple timers) to advanced variants (such as microprocessor control).
(l) Allowing adjustments, such as adjusting the valve opening and dwell times based on reservoir pressure for insuring reasonably consistent (and/or selectable) shot velocity and/or for tailoring performance.
(m) Adjusting air efficiency by control of the valve operation.
(n) Increasing reliability due to the relatively limited parts count and small number of moving parts.
(o) Reducing wear by reducing or eliminating nearly all wear surfaces, including significant impact surfaces as common with mechanical and/or electrical/solenoid hammer-based systems.
(p) Providing for relatively limited-power capable supply sources by utilizing pulse capacitor storage and dead-time recharging.
(q) Optionally decoupling the projectile feed system from the propellant feed thereby allowing a wide variety of magazine options.
(r) Increasing safety aspects by allowing the device to be deactivated with electronic safeties and interlocks, if desired.
(s) Allowing multiple propellants via electronic and/or mechanical adjustments.
(t) Allowing operation over a range of supply pressures.
(u) Potentially allowing implementation of pellet firing versions via loading bolt variants, non-loading bolt variants, and/or lightweight spring feed, and/or "revolver" style rotating magazines, among other mechanisms.
(v) Providing a reasonably compact form factor.
(w) Allowing for various firing rate patterns, including burst modes.

(x) Applicability to range of power levels from below low-powered "airsoft" style devices through beyond big-bore hunting airguns.

(y) Allowing for lower pressure operation than typical with hammer-based valve devices while still retaining reasonable performance (partly due to controllable dwell time).

(z) Providing conservative use of available power supply in some embodiments—initial pulse current can be greatest when required force is highest, and holding current becomes minor as pressure becomes more closely equalized after the valve opening, thus resulting in a relatively smaller required holding force. In addition, once the solenoid is active and valve is open, required holding current becomes smaller as the solenoid air gap is reduced, thus also reducing current required for dwell-time operation. This allows a relatively low-current to help maintain dwell time.

(aa) Allowing the optional use of a capacitor-free system, whereby a suitable-current electrical power source (such as a battery or other source), can be fed directly to the power control system.

(ab) Allowing the optional elimination of a pressure-regulator via the alternative use of controllable valve timing (ac) Potentially allowing a cooling mechanism for the valve actuator (solenoid or other) via propellant flow.

(ad) Potentially providing a propellant heating mechanism via heat transfer between the valve actuator/power circuitry and the propellant, thereby potentially increasing the propellant energy.

(ae) Allowing use of closed-loop or open-loop control mechanisms; sensor/sensor-free systems.

(af) Potentially allowing electronic and/or mechanical control implementations.

The above list is only to provide representations of some possible advantages, one or more of which may be present in some embodiments of the present invention; the above list does not in any way constitute (nor should in any way be construed) as an inclusive or exclusive list. There are certainly many other advantages that may be evident from the prior detailed description, and these are only some possibilities, one or more of which may exist in some embodiments.

Therefore, and without suggesting or implying any limit to the present invention's scope, some embodiments overcome some shortcomings of the prior art by by providing a method capable of launching successive projectiles and automatically cycling the action with comparatively low system complexity, potentially low manufacturing costs, potentially improved performance and reliability, and substantial flexibility in implementation, including but not limited to: allowing straightforward implementation of select-fire modes and/or containing few moving parts, few or even zero critical sliding seals, no required impact surfaces, and can potentially decouple the projectile feed mechanisms from the main propellant delivery and valving mechanisms, among other aspects. Additionally, some embodiments can provide for adjustable rates-of-fire, adjustable shot-velocity, and flexibility in tuning shot velocity profiles over a range of operating pressures. Further, they can allow for inexpensive development and manufacture while retaining high quality and reliability, and provide the potential for increased performance, among other aspects.

I claim:

1. An airgun comprising:

(a) a direct-acting, spool-free, hammer-less actuated valve whereby suitable control of said valve enables said airgun to be operated in an automatic mode.

2. The airgun of claim 1 wherein said automatic mode comprises one or more of semi-automatic, fully-automatic, burst-automatic, or other automatic modes.

3. The airgun of claim 1 wherein said suitable control comprises one or more control means.

4. The airgun of claim 3 wherein said control means comprises an adjustment means for providing adjustments to rate-of-tire, valve dynamics, muzzle velocity, or other operational parameters.

5. The airgun of claim 4 wherein said control means comprises a mechanical, chemical, thermal, or any other suitable means.

6. The airgun of claim 4 wherein said control means comprises means for providing selection of said automatic mode.

7. The airgun of claim 3 wherein said control means comprises an electronic or electrical means.

8. The airgun of claim 7 wherein said electronic or electrical means comprises discrete components.

9. The airgun of claim 7 wherein said electronic or electrical means comprises one or more integrated circuits.

10. The airgun of claim 7 wherein said electronic or electrical means comprises a sensor-free means.

11. The airgun of claim 7 wherein said electronic or electrical means comprises a sensor-based means.

12. The airgun of claim 1 wherein said valve comprises an electro-mechanical actuator means.

13. The airgun of claim 12 wherein said electro-mechanical actuator means is a solenoid.

14. The airgun of claim 12 wherein said electro-mechanical actuator means is a motor.

15. The airgun of claim 12 wherein said electro-mechanical actuator means comprises components which are fully or partly located in a pressurized area.

16. The airgun of claim 15 wherein said components which are fully or partly located inside a pressurized area comprise a plunger which is directly attached to a valve seal.

17. The airgun of claim 15 wherein said components which are fully or partly located inside a pressurized area comprise a coil which resides outside said pressurized area.

18. The airgun of claim 15 wherein said components which are fully or partly located inside a pressurized area comprise a coil which resides inside said pressurized area.

19. The airgun of claim 1 wherein said valve comprises a mechanical, chemical, thermal, or any other suitable actuator means.

20. The airgun of claim 1 wherein said valve comprises a poppet arrangement.

21. The airgun of claim 1 wherein said valve comprises any suitable valve arrangement.

22. The airgun of claim 1 wherein said valve comprises a solenoid.

23. The airgun of claim 1 further including a power means for generating electrical power.

24. The airgun of claim 23 wherein said power means comprises a battery, generator, fuel cell, or any other suitable power generation means.

25. A method for an airgun comprising:

(a) controlling a direct-acting, spool-free, hammer-less actuated valve whereby said airgun can function in an automatic mode.

26. The method of claim 25 wherein said automatic mode comprises one or more of semi-automatic, fully-automatic, burst-automatic, or other automatic modes.

27. The method of claim 25 wherein said valve is controlled via an electrical or electronic means.

28. The method of claim 27 wherein said electrical or electronic means comprises a sensor-free means.

29. The method of claim 27 wherein said electrical or electronic means comprises a sensor-based means.

30. The method of claim 25 wherein said valve is controlled via a mechanical, chemical, thermal, or other suitable means.

31. The method of claim 25 wherein said automatic mode may be selected from a plurality of automatic modes.

32. The method of claim 25 wherein said valve may be controlled to provide cyclic rate, throw, timing, or other parameters.

* * * * *